US007458179B2

(12) United States Patent
Swan

(10) Patent No.: US 7,458,179 B2
(45) Date of Patent: Dec. 2, 2008

(54) MODULAR PANEL SYSTEM FOR ATTACHING ACCESSORIES TO A FIREARM RAIL SYSTEM

(76) Inventor: Richard E. Swan, 171 West St., East Bridgewater, MA (US) 02333

( * ) Notice: Subject to any disclaimer, the term of this patent is extended or adjusted under 35 U.S.C. 154(b) by 400 days.

(21) Appl. No.: 11/085,858

(22) Filed: Mar. 22, 2005

(65) Prior Publication Data

US 2005/0241211 A1 Nov. 3, 2005

Related U.S. Application Data

(60) Provisional application No. 60/556,568, filed on Mar. 26, 2004.

(51) Int. Cl.
*F41C 27/06* (2006.01)

(52) U.S. Cl. ..... 42/72; 42/105

(58) Field of Classification Search ..... 42/105, 42/71.01, 72

See application file for complete search history.

(56) References Cited

U.S. PATENT DOCUMENTS

| | | | | |
|---|---|---|---|---|
| 4,536,982 | A * | 8/1985 | Bredbury et al. | 42/71.01 |
| 4,733,489 | A | 3/1988 | Kurak | 42/77 |
| 4,934,085 | A | 6/1990 | Lough | 42/100 |
| 4,941,277 | A | 7/1990 | Lawlor | 42/100 |
| 5,010,676 | A | 4/1991 | Kennedy | 42/71.01 |
| 5,198,600 | A | 3/1993 | E'Nama | 42/90 |
| 5,522,166 | A | 6/1996 | Martel | 42/101 |
| 5,533,292 | A | 7/1996 | Swan | 42/100 |
| 5,590,484 | A | 1/1997 | Mooney et al. | 42/100 |
| 5,694,712 | A | 12/1997 | Plonka | 42/101 |
| 5,826,363 | A | 10/1998 | Olson | 42/75.01 |
| 5,941,489 | A | 8/1999 | Fannelli et al. | 248/298.1 |
| 6,381,895 | B1 | 5/2002 | Keeney et al. | 42/124 |
| 6,453,594 | B1 | 9/2002 | Griffin | 42/105 |
| 6,490,822 | B1 | 12/2002 | Swan | 42/71.01 |
| 6,499,245 | B1 | 12/2002 | Swan | 42/71.01 |
| 6,508,027 | B1 | 1/2003 | Kim | 42/124 |
| 6,606,813 | B1 | 8/2003 | Squire et al. | 42/90 |
| 6,618,976 | B1 | 9/2003 | Swan | 42/114 |
| 6,655,069 | B2 | 12/2003 | Kim | 42/114 |
| 6,779,288 | B1 * | 8/2004 | Kim | 42/72 |
| 2001/0022044 | A1 | 9/2001 | Spinner | 42/124 |
| 2001/0027620 | A1 | 10/2001 | Wooten et al. | 42/124 |
| 2004/0000083 | A1 | 1/2004 | Grant, Jr. | 42/112 |
| 2004/0035991 | A1 | 2/2004 | Wooten et al. | 248/229.1 |

* cited by examiner

*Primary Examiner*—Stephen M Johnson
(74) *Attorney, Agent, or Firm*—Barlow, Josephs & Holmes, Ltd.

(57) ABSTRACT

A reconfigurable modular interface system for an integrated and standardized weapons system is disclosed. An upper accessory mount is provided that includes one interface for mounting to the desired primary mounting component, such as a firearm. The upper accessory mount further includes a second interface along its bottom edge for attaching accessories thereto. Accessories to be mounted into the modular interface system may either include mating formations that are provided as integrated OEM parts or through the use of retrofit adapter panels mounted to the secondary device.

20 Claims, 11 Drawing Sheets

MODULAR PANEL SYSTEM FOR ATTACHING ACCESSORIES TO A FIREARM RAIL SYSTEM

CROSS-REFERENCE TO RELATED APPLICATIONS

This application is related to and claims priority from earlier filed U.S. Provisional Patent Application No. 60/556,568, filed Mar. 26, 2004.

BACKGROUND OF THE INVENTION

The present invention relates generally to modular attachment systems for weapons. More specifically, the present invention relates to a modular panel system that is integrated to mount onto an accessory rail system in order to interface additional equipment onto a firearm or another support structure.

As the field of combat and commercial weaponry expands, numerous add-on enhancements have become available for attachment to standard firearms, thereby significantly upgrading the capability of the firearm. Various methods and means have been developed for interfacing these various add-on enhancements to a wide array of firearms. For example, U.S. Pat. No. 4,845,871 discloses a quickly detachable-interface means for modular enhancements. Similarly, U.S. Pat. No. 5,142,806 discloses a universal receiver sleeve having an upper interface portion with standard, universal dimensions that are modular and configured to receive any accessory mount while the receiver sleeve further includes a lower interface portion that is specific to the particular firearm with which it will be employed. Another interface means is disclosed in U.S. Pat. No. 5,343,650 where an extended rigid interface frame including upper and lower rails is shown. The interface frame is joined to a firearm receiver where a yoke braces the extended rigid frame receiver sleeve to the forward portion of the firearm's receiver. The interface frame extends forward around the firearm's barrel between the front of the receiver and a head assembly that is attached on the front end of the barrel thereby replacing the firearm's normal front sight. A weaver type interface rail is provided both above and below the barrel from the head assembly to the receiver. In Some types of rigid interface frames are supported entirely by the yoke at the front of the receiver. In this case, the distal end of the extended rigid frame terminates in a front sight housing, which connects the upper and lower rails and provides a housing for advanced laser and sensor components and the standard front sight bead. The front sight housing is self-supported by the connection of the upper and lower rails running back to the yoke and secured to the top of the receiver. In this manner, the barrel of the rifle is free floating in that it does not touch the extended rigid frame in any manner. This permits greater shooting accuracy and protects sensitive electrical components within the front sight housing by isolating the front sight housing from the heat generated from the barrel.

Although the principles of the above-identified patented devices are generally applicable to all firearms, the specific firearm example identified in each patent was the U.S. military M16 rifle and carbine. The M16 has been in service for a number of years and will continue to be a popular rifle both in the U.S. military and foreign military for the foreseeable future. However, with the increasing development and refinement of laser technology and other technologies, it has become highly desirable to integrate the ability to mount modular attachments onto and into firearms.

As can be appreciated, the problem with integrating modular attachments onto firearms is the inherent conflict between a gun barrel's physical functioning and the additional weight and/or shocks that may be introduced thereto resulting from the attachment of additional accessories. To obtain the best and most reliable performance, a gun barrel should be physically isolated, i.e., "floating". It is preferred that nothing be attached to the gun barrel, thereby isolating the barrel physically and eliminating bending and "droop" along the barrel's longitudinal axis. The ideal mounting arrangement for modular attachments, therefore, is one where the attachment is completely isolated from the gun barrel. This isolation serves two functional purposes. First, during operation, the temperature of a gun barrel can rise to 900.degree. F. This type of heat, as well as the physical shock transferred through the gun barrel during firing, can damage or destroy any attachments that are mounted in direct contact with the barrel. The heat generated by the gun barrel is transferred to any devices mounted thereon, resulting in the direct transfer of enough heat to burn a user's hands and interfere with the operation of any attachments. The second issue compounding this problem is the requirement that in order to support the loads imposed by mounting attachments to the barrel of the firearm, the barrels need be extra heavy to support the added weight and shock forces. For example, a grenade launcher attachment not only introduces additional weight to the barrel, it also introduces substantial recoil in operation. This recoil force is transferred into the firearm through the attachment of the grenade launcher to the barrel. This in turn means more cantilevered stress on the barrel where it is joined with the M-16's aluminum receiver. The combination of heat and force applied to the barrel in this manner tends to pull the barrel chamber out of alignment with the bolt lead, thereby causing bolt lug and extractor failure, ultimately jamming the firearm.

There is thus a need for a unique modular support design for mounting accessories to a firearm that serves to support the accessory without introducing loads or additional stresses into the barrel of the firearm. There is an additional need for such a modular support to have a large stable interface in order to support heavier accessories such as a grenade launcher. Further, there is a need for providing a means for retrofitting preexisting equipment to facilitate integration with a modular support system thereby allowing for easy mounting, removal and interchangeability.

BRIEF SUMMARY OF THE INVENTION

In this regard, the present invention provides a modular interface system for mounting accessory devices onto other primary devices, such as for example, mounting a secondary grenade launcher onto an M16 rifle. As such, the general purpose of the present invention, which will be described subsequently in greater detail, is to provide a new and improved modular interface system for mounting modular accessories onto firearms or other desired mounting locations without requiring that they be attached to, or supported by the gun barrel.

The present invention is disclosed in the context of a Swan universal receiver rail although the teachings herein are applicable to a broad variety of different sleeve and/or rail interface platforms. In general, the present invention utilizes a Swan universal receiver rail assembly as the platform for constructing a modular interface system that allows for the attachment of additional accessories. The present invention will be described in terms of its integration with the three popular formats of rail assemblies, namely rails that include an upper sleeve portion that extends over and attaches to the upper receiver of the firearm, rails that derive their support from the existing firearm barrel nut attachment and rails that utilize a replacement barrel nut.

In the first case, the rail system includes an extended upper sleeve portion that serves to support the rail system by attaching to the upper receiver of the firearm. The upper rear portion of the receiver rail attaches to the top of the receiver of a firearm and generally includes a portion that extends forward above the firearm barrel to a position just short of the firearm front sight. The underside of the rear portion of the rail is fixedly attached to the receiver top. The underside of the forward portion of the rail has an upper accessory mount attached thereto. A removable lower accessory such as a bottom hand guard piece or a modular accessory mounted in accordance with the present invention is fitted about the bottom of the gun barrel and is attached to the upper accessory mount via a unique channel and track system. The upper accessory mount and lower accessory pieces are not physically connected to, or supported in any way by the gun barrel. The upper accessory mount is self-supported by the connection of the rear portion of the rail to the top of receiver.

In the second embodiment, the modular interface system includes an upper accessory mount with a mounting element such as a Swan rail or a flat plate extending along the top thereof, the rear extension portion of the accessory mount that extends over the firearm receiver for connecting the device to a firearm receiver is eliminated. In place of the rearward rail extension, means for interfacing the upper accessory mount with the barrel nut attached to the front of the firearm receiver is provided. The side walls of the upper accessory mount terminate in a channel and track interface that includes mating formations for receiving and retaining the lower accessory in a mounted position. The unique channel and track interface is the feature of the present invention that allows the mounting of lower accessories to the modular interface system.

Finally, as was provided above, the rear portion of the upper accessory mount interface that extends over the firearm upper receiver is eliminated and a replacement barrel nut is utilized, in this manner, the upper accessory mount is attached to the replacement barrel nut using attachment means such as a clamping assembly or fasteners installed directly into the replacement barrel nut.

In each of the embodiments, the upper accessory mount is preferably made up of a universal receiver rail having a top side, an underside and two opposite sides connecting the top side with the underside, the universal receiver rail further including at least a forward portion and optionally rear portion. If the assembly includes the rear rail portion, the underside of the rear portion of the rail is configured to be fixedly attached to the top of a firearm receiver, with the front portion of the rail extending forward above the firearm barrel. The upper accessory mount has opposing side walls that extend downwardly from the bottom of the front portion of the rail. Similarly, if the upper accessory mount is intended for mounting in alternate locations such as onto the side of a vehicle, the rail will not include a rear portion. In this configuration the top of the front portion of the rail will be formed into a Weaver type interface or may be simply flat to allow the accessory interface to be mounted onto a flat surface.

The present invention provides a foundation for integrated laser fire control devices, sensors, communications, and a vast array of quickly attached ancillary devices, such as standard night vision, thermal, shot guns, grenade launchers, and other special systems. In particular, since the upper accessory mount of the present invention has a large platform relative to previous rail mounting systems, it allows the mounting of larger accessories such as grenade launchers. Further the present invention allows for retrofitting accessories with adapter panels to allow existing equipment to be mounted into the modular interface system.

It is therefore an object of the present invention to provide a modular interface system that allows ancillary devices to be removably mounted onto a firearm. It is a further object of the present invention to provide a unique modular interface system designed for mounting lower accessories to a firearm that serves to support the accessory without introducing loads or additional stresses into the barrel of the firearm. It is yet a further object of the present invention to provide a modular interface system that includes a large stable interface in order to support heavier accessories such as a grenade launcher. It is still a further object of the present invention to provide a means for retrofitting preexisting equipment to facilitate integration with a modular interface system thereby allowing for easy mounting, removal and interchangeability.

These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
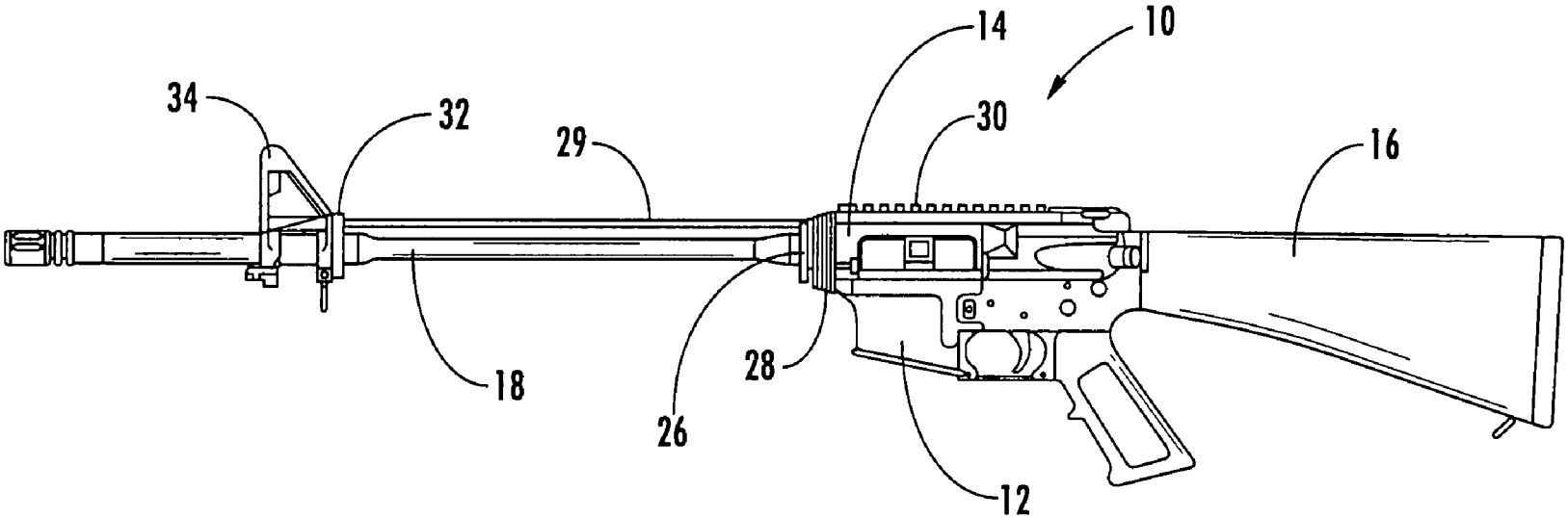
FIG. 1 is a plan view of a conventional M16 firearm with the standard hand guards removed to show the barrel, barrel nut and delta ring.
Figure 2:
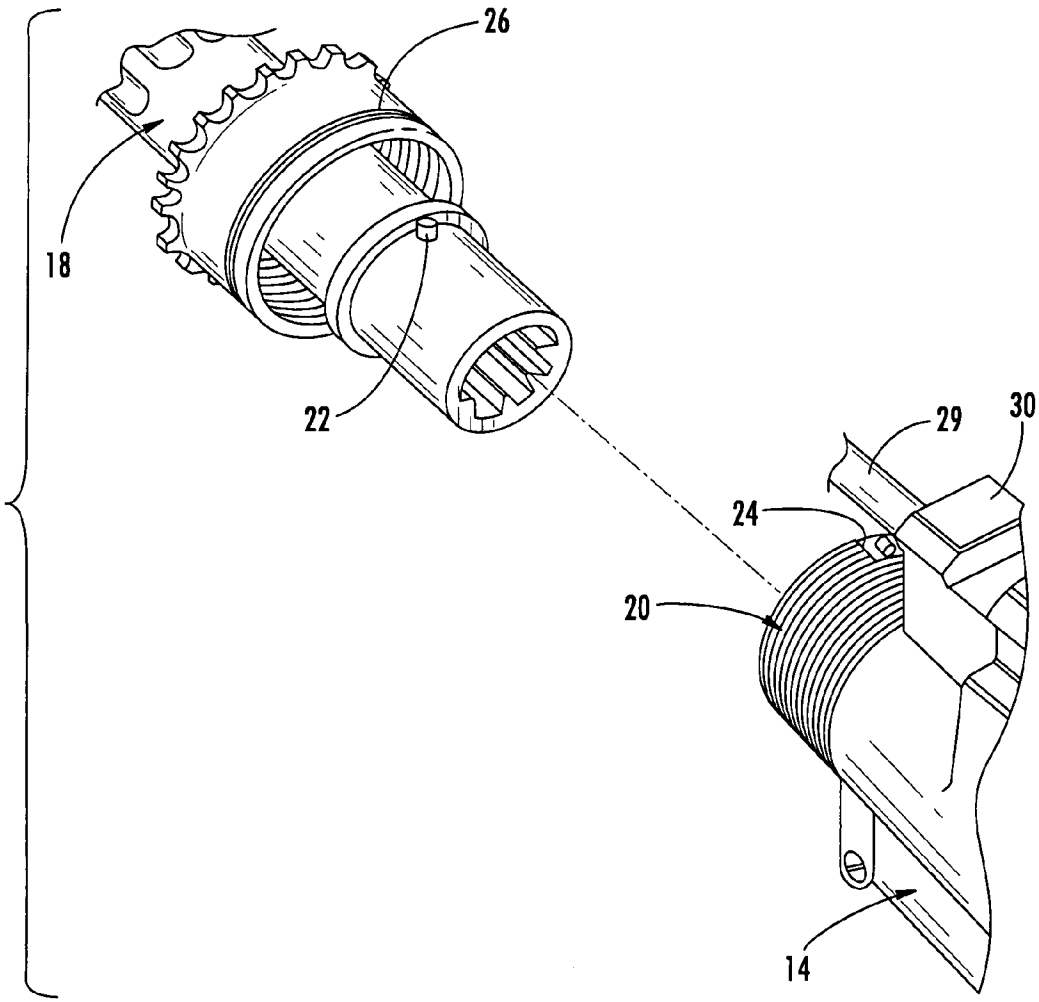
FIG. 2 is an exploded perspective view of the front end of the upper receiver, the rear end of the barrel and the barrel nut.

Now referring to the drawings, the modular interface system of the present invention is shown and generally illustrated in the figures. Referring first to FIG. 1, a M16/M4 firearm is shown and generally indicated at 10. (M16 and M4 are trademarks of Colt Defense, Inc.). The M16 has been in service for a number of years and will continue to be a popular rifle both in the U.S. military and foreign military for the foreseeable future. Generally, the M16/M4 weapon 10 includes a lower receiver 12, upper receiver 14, butt stock 16, and barrel 18. Referring now to FIGS. 1 and 2, the barrel 18 is attached to the front of the upper receiver 14 by inserting the rear end of the barrel into a barrel-receiving receptacle 20 at the front end of the upper receiver 14. A pin 22 on the barrel 18 aligns with a notch 24 in the barrel-receiving receptacle 20 for proper alignment. The barrel 18 is held in assembled relation with the upper receiver 14 by a barrel nut 26 that is threaded onto the outside surface of the barrel-receiving receptacle 20. A "delta ring" 28 (FIG. 1) encircles the barrel nut 26 and provides a spring loaded ring for attachment of the M16/M4 standard hand guards (not shown) between the delta ring and a forward receptor cap 32 mounted at the front end of the barrel 18. A gas tube 29 extends from the upper receiver 14 to the receptor cap 32 at the front end of the barrel 18. The standard hand guards, when installed, serve to encircle and protect both the barrel 18 and gas tube 29.

It should be appreciated that while the base firearm described herein is an M16/M4 weapon 10, the disclosure of the present invention is applicable to any rifle. While specific components and features of the M16/M4 weapon 10 are described in detail for the purpose of illustration and clarity, any one skilled in the art can easily apply the teachings of the present application to any of the rifles available on the market today.

The newer models of the M16/M4 weapons further include a mil-std 1913 dovetail rail 30 extending along the top of the upper receiver 14. This integrated receiver rail 30 provides a convenient mounting point for many types of enhancement devices such as scopes and other sighting devices. However, space on the upper receiver rail 30 is limited, and many military personnel often have multiple sighting devices. In addition, there are a variety of lighting devices, handgrips, etc. that could also be attached to the weapon for enhanced use of the weapon, but there is simply not enough space on the upper receiver rail 30 to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails or other sturdier interface formats that can support this important equipment and yet stand the test of rugged military use and abuse.

Figure 3:
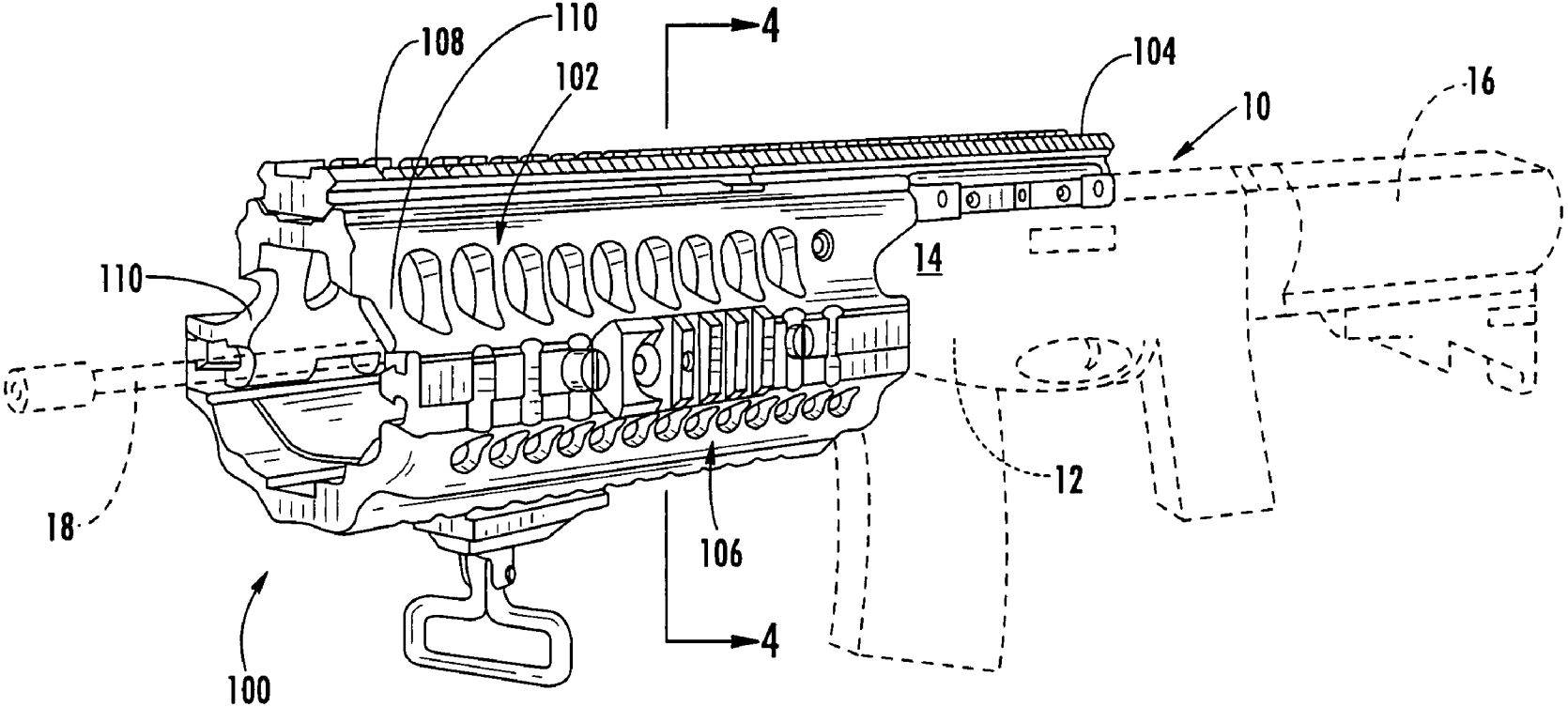
FIG. 3 is a perspective view of a first embodiment of the modular interface system of the present invention including a lower hand guard accessory.
Figure 4:
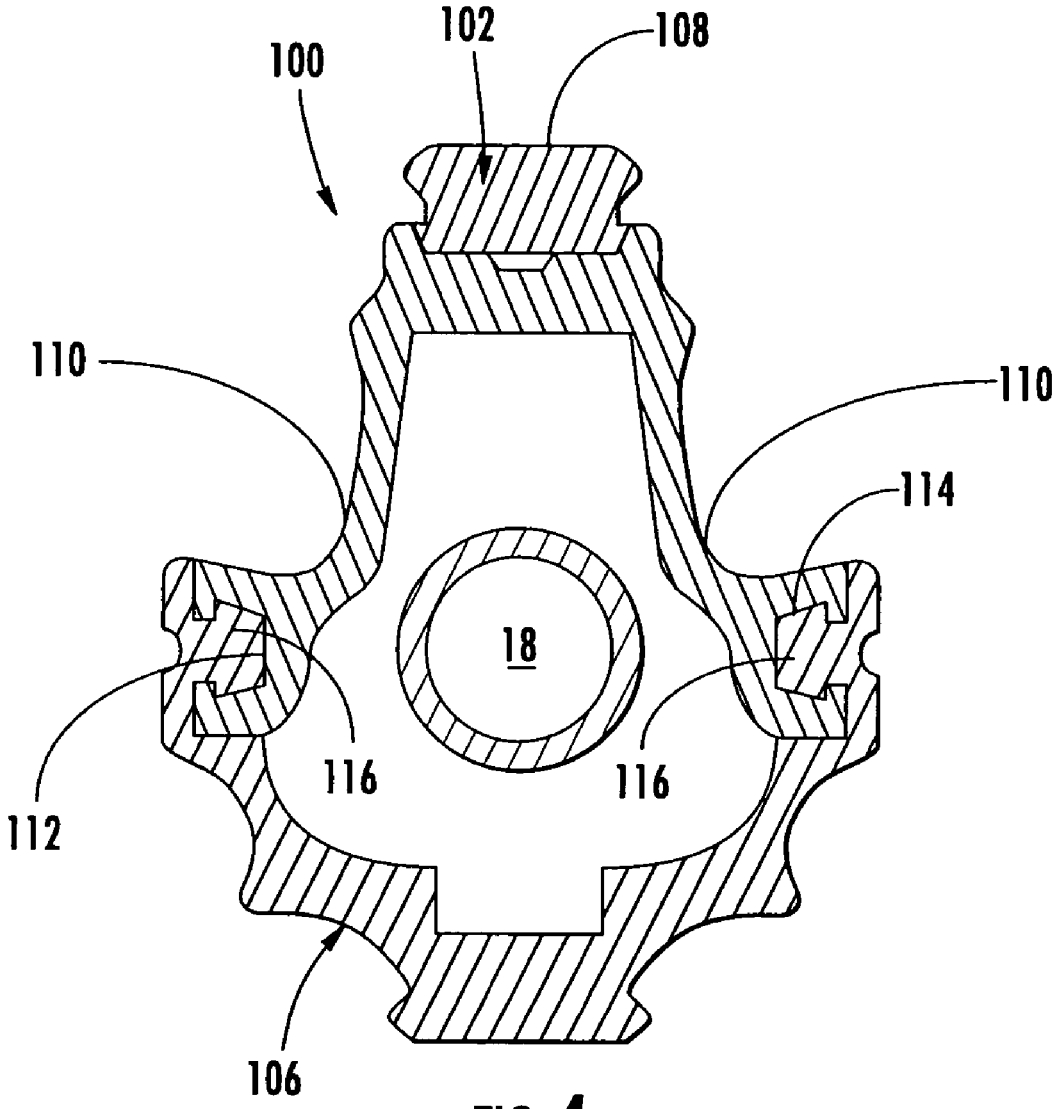
FIG. 4 is a cross-sectional view taken along line 4-4 in FIG. 3 of a modular interface, with a bottom hand guard attached.
Figure 5:
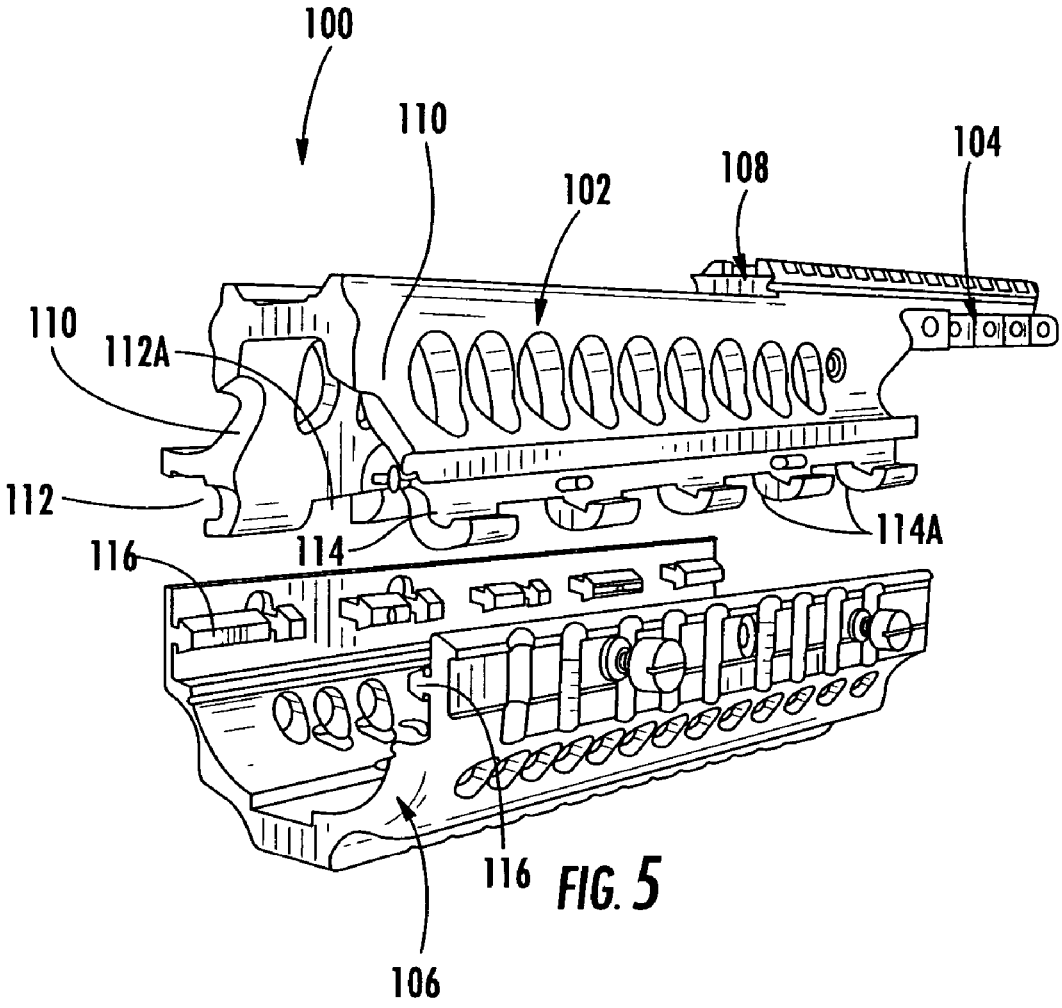
FIG. 5 is a perspective view of a first embodiment of the modular interface system of the present invention showing the lower hand guard accessory removed.

In this context, FIG. 3 shows a preferred embodiment of the modular interface system 100 of the present invention installed onto a M16 firearm 10. The modular interface system 100 includes an upper accessory mount generally indicated at 102, a means for interfacing the upper accessory mount 102 with the firearm generally indicated at 104 and a lower firearm accessory generally indicated at 106. In terms of this embodiment of the modular interface system 100, the means for interfacing the upper accessory mount 102 with the firearm 10 is shown as a sleeve 104 extending rearwardly from the upper accessory mount 102 in a manner that extends over the upper receiver 14 of the firearm 10 and engages the dovetail rail 30 provided thereon. The upper accessory mount 102 is the main structural element of the modular interface system 100 and serves to interface with the upper receiver 14 of the firearm 10 and thereby provides the necessary support for receiving and reliably retaining lower accessories 106 without transferring any of the loads generated thereby to the barrel 18 of the firearm 10. The upper accessory mount 102 is generally semi-cylindrical in shape, has a forward end and a rearward end and preferably includes a mil-std 1913 dovetail rail 108 extending longitudinally along the upper surface between the forward end and the rearward end, although the inclusion of a dovetail rail 30 is not critical to the present invention. As can best be seen in FIG. 4, The semi-cylindrical upper accessory mount 102 further includes symmetrically opposing side walls 110 that extend outwardly and downwardly from the dovetail rail 108 and terminate in symmetrically opposing longitudinally extending mounting channels 112, 114. Turning now to FIG. 5, the modular interface system 100 is shown removed from the firearm 10 and the upper accessory mount 102 is shown with the lower hand guard accessory 106 removed to better illustrate the configuration of the mounting channels 112, 114. The upper accessory mount 102 can be seen to include mounting channels 112, 114 formed on the outer surfaces of the opposing side walls 110. The mounting channels 112, 114 provide the interface by which ancillary equipment or accessories are mounted onto the modular interface system 100. The mounting channels 112,114 in the preferred embodiment are formed to have a generally female, T-shaped cross section. As is shown in this embodiment, the bottom hand guard accessory 106 includes at least one longitudinal T-shaped protrusion 116 positioned near to the top on each of the opposing inner side walls where each protrusion 116 is a mirror of the other. The bottom hand guard accessory 106 is adapted to being joined to the upper accessory mount 102 by sliding the bottom hand guard 106 longitudinal T-shaped protrusion 116 into the mounting channels 112, 114 in the upper accessory mount 102. In similar fashion any other accessories that are to be integrated into the modular interface system 100 of the present invention would include the required protrusions 116 to engage the mounting channels 112, 114 in the same way that the bottom hand guard 106 accessory does.

It should be appreciated that in the preferred embodiments as described herein, the mating formations are formed as generally T-shaped projections 116 that are slidably received within the mounting channels 112, 114. In this manner, the mounting channels 112,114 are used to mount various accessories, such as the lower hand guard accessory 106. Further, the present invention provides, as will be described in detail below, adapter panels for interfacing various other accessories such as a grenade launcher with the upper accessory mount 102. Furthermore, to make the upper hand accessory mount 102 compatible with lower hand guards of prior rail systems produced by the applicant, and to make the mounting and removal of the lower accessory 106 easier, the lower wall of the mounting channels 112,114 are provided with interrupted wall segments 112A, 114A. The provision of the interrupted wall segments 112A, 114A allow for the mounting and removal of a lower accessory 106 without having to slide the lower accessory 106 the entire length of the unbroken mounting channel 112, 114. However, the modular interface system 100 need not include the interrupted wall segments 112A, 114A. The removable hand guard system including the interrupted wall segments and interrupted lug projections are described in greater detail in U.S. Pat. No. 6,499,245, the entire contents of which are incorporated herein by reference.

Figure 6:
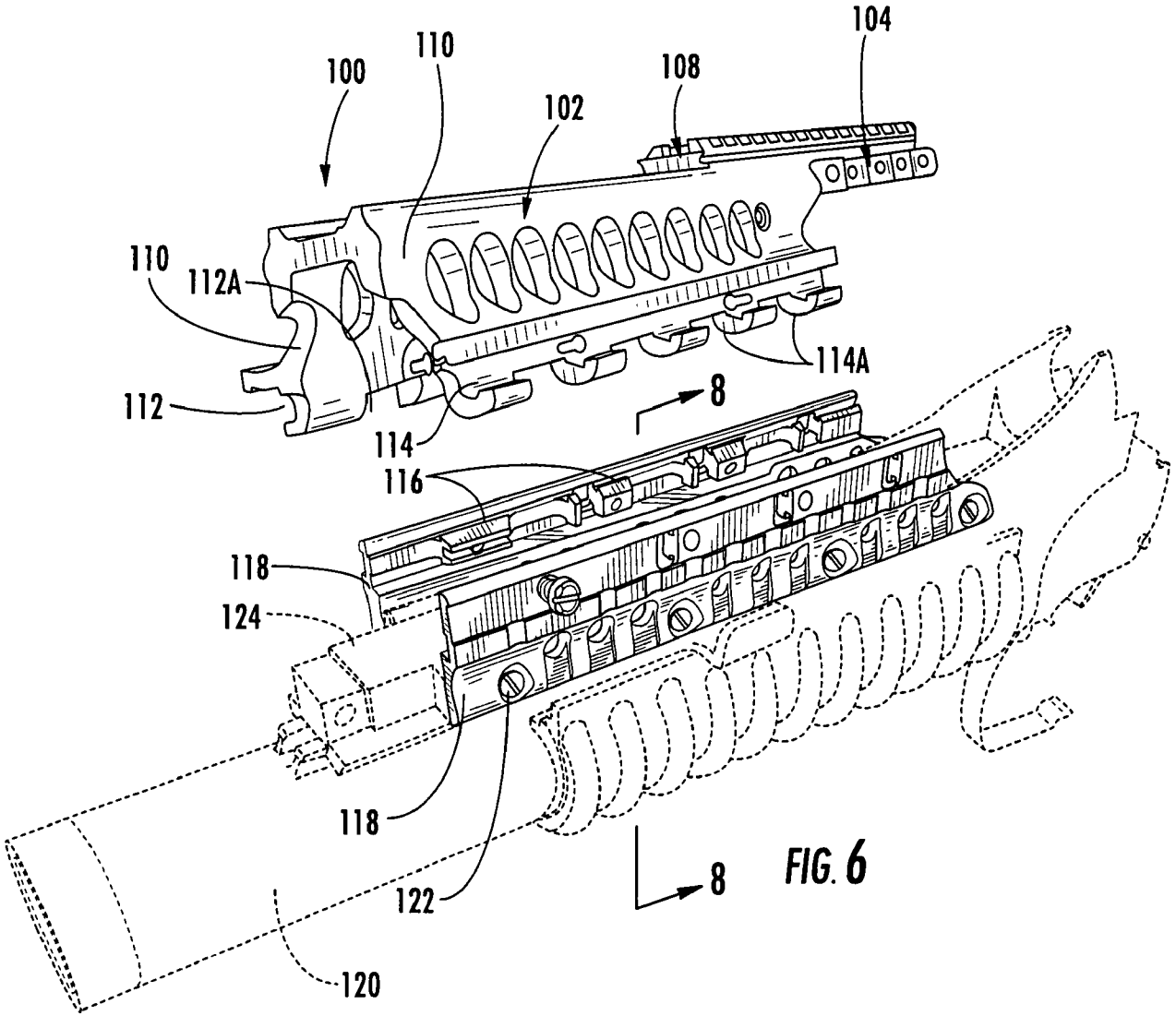
FIG. 6 is a perspective view of a second embodiment of the modular interface system of the present invention showing the adapter panels and lower grenade launcher accessory removed.
Figure 7:
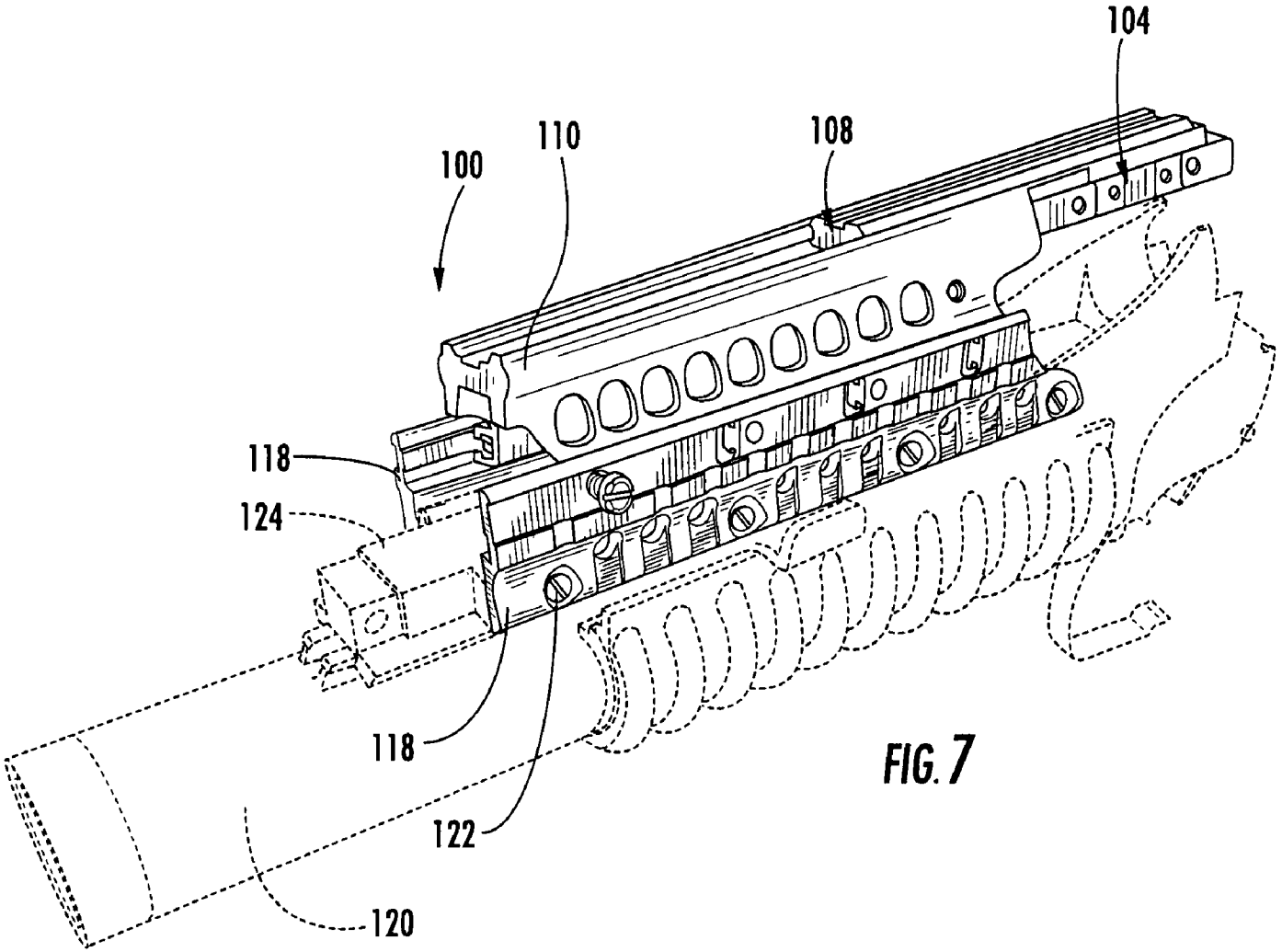
FIG. 7 is a perspective view of a second embodiment of the modular interface system of the present invention including adapter panels and a lower grenade launcher accessory.
Figure 8:
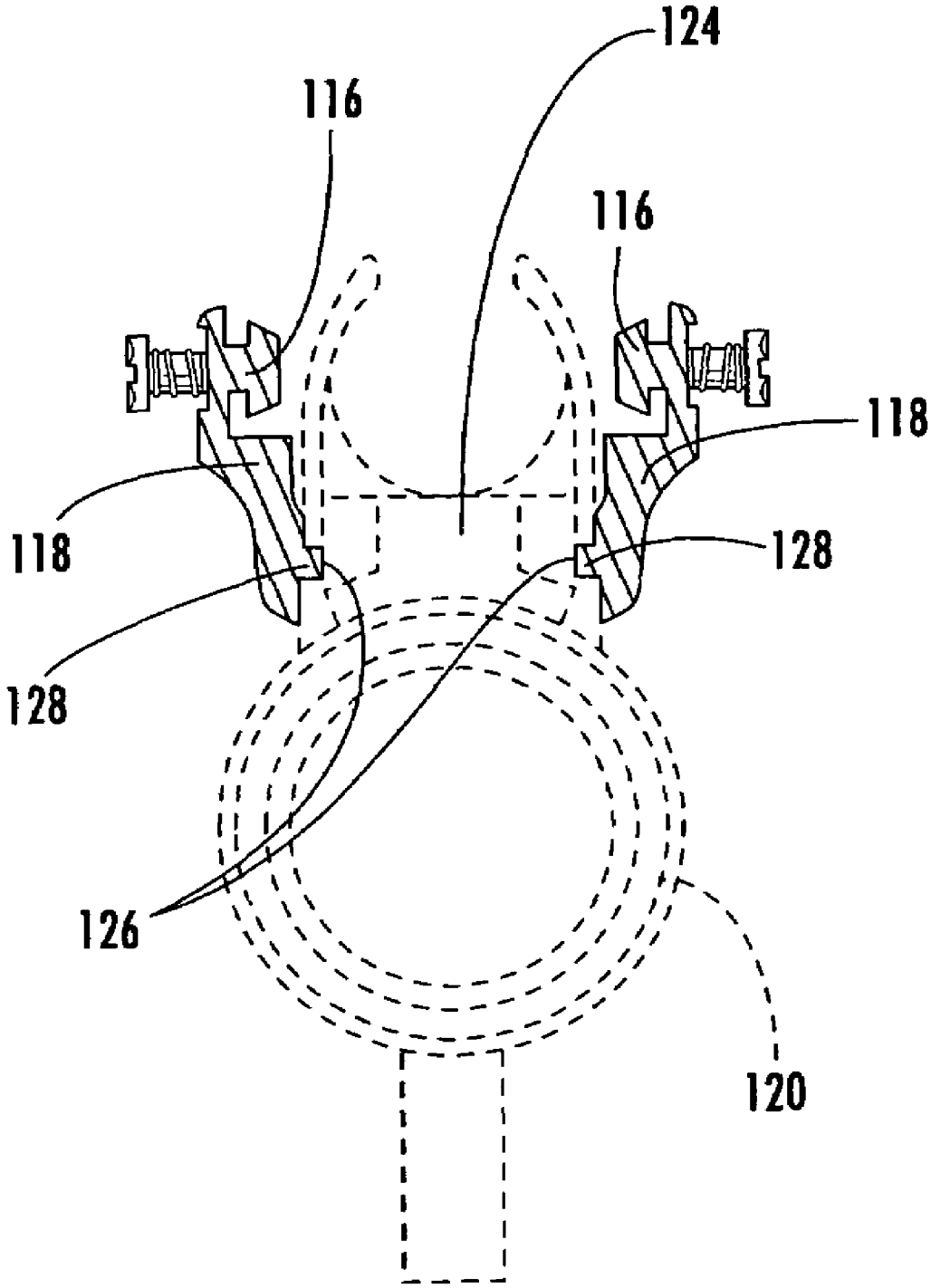
FIG. 8 is a cross-sectional view taken along line 8-8 in FIG. 6 of the adapter panels and a lower grenade launcher accessory.

Turning to FIGS. 6-8, symmetrically opposed adapter panels 118 are shown for integrating various accessory devices with modular interface system 100 by engaging the upper accessory mount 102 of the present invention. The adapter panels 118 can be integrated into various accessory devices as standard components, formed into the housings thereof or the accessory devices can be retrofit to allow mounting of the adapter panels 118 thereby allowing a wide range of accessory devices to be interfaced with the upper accessory mount 102. In the figures, adapter panels 118 for integrating a grenade launcher 120 into the modular interface system 100 are shown and disclosed. While a standard 40 mm M203 military grenade launcher 120 is shown, it can be appreciated that the teachings of the present invention can be utilized to integrate any other device into the interface of the present invention.

In particular, the present invention provides for adapter panels 118 that have a top edge and a bottom edge. The bottom edges of the adapter panels 118 are configured for attachment onto the desired accessory device to be mounted. The lower edges of the adapter panels are attached onto the accessory device preferably by threaded fasteners 122 such as screws, although any other suitable fastener would fall within the scope of the disclosure. Similarly, the housing of the accessory device may be formed to include the adapter panels, as an integrated component such as is the case with the lower hand guard accessory 106. With particular reference to the grenade launcher 120, the lower edges of the adapter panels 118 are fastened to the breech 124 of the grenade launcher 120 with screws 122. Once the adapter panels 118 mounted to the accessory device, the device in turn can then be received onto the upper accessory mount 102. The top edge of the adapter panels 118 includes longitudinal T-shaped projections 116 positioned near to the top edge. In this manner, the adapter panels 118 are configured in a manner that allows them to be mounted into the upper accessory mount 102 by sliding the longitudinal T-shaped projections 116 on the top edge of the adapter panels 118 into the mounting channels 112, 114 on the upper accessory mount 102. The lower accessory 120 is thereby firmly mounted into the modular interface 100 and retained by the upper accessory mount 102 via the adapter panels 118 as is shown in FIG. 7. Further, the upper accessory mount 102 and the lower accessory 120 are not physically connected in any way to the gun barrel 18. The upper accessory mount 102 and the lower accessory 120 are self-supported by the connection of the rear portion of the modular interface 100 to the upper receiver 14 of the firearm 10.

It can be appreciated that the present invention discloses the use of retrofit adapter panels 118, as there are a great number and variety of previously manufactured devices that a user may wish to integrate into the present modular interface system 100. Turning to the cross-section shown in FIG. 8, it can be seen that to enhance the quality and strength of the connection between the retrofit adapter panels 118 and the accessory device 120 to be mounted, the walls in the breech 124 of the device 120 may be further milled to include a longitudinal channel 126 therein. The retrofit adapter panels 118 can be seen to include a key type interface 128 that is received into the channel 126 to increase the rigidity of this particular connection. The retrofit adapter panels 118 are then fastened into place on the accessory device 120 using any appropriate type fastener known in the art. It should be clear that this manner of mounting an accessory can be utilized with nearly any desirable structure simply by adjusting the particular shape of the adapter panels 118 and the relative placement and angles of the mounting surfaces and the interface structures at the top edge of the adapter panels 118.

Further, while adapter panels 118 are shown, the disclosure is not limited to use with retrofitting existing equipment. Clearly the present modular interface system 100 anticipates use as a standard mount for incorporation into newly manufactured equipment in an integral fashion. The ultimate teaching of the present invention is the provision of a standard interface system that allows the integration of various pieces of equipment in a modular fashion. Further, it provides for example the means to mount a grenade launcher 120 or any other desirable accessory to either a firearm, the side of a helicopter or a tank without requiring any modification. For the applications discussed where the modular interface system 100 is utilized with mounting conditions other than attachment to a firearm 10, numerous upper accessory mounts 102 would simply be mounted in the desired interface locations and the lower accessory 120 moved from one location to the next.

Figure 9:
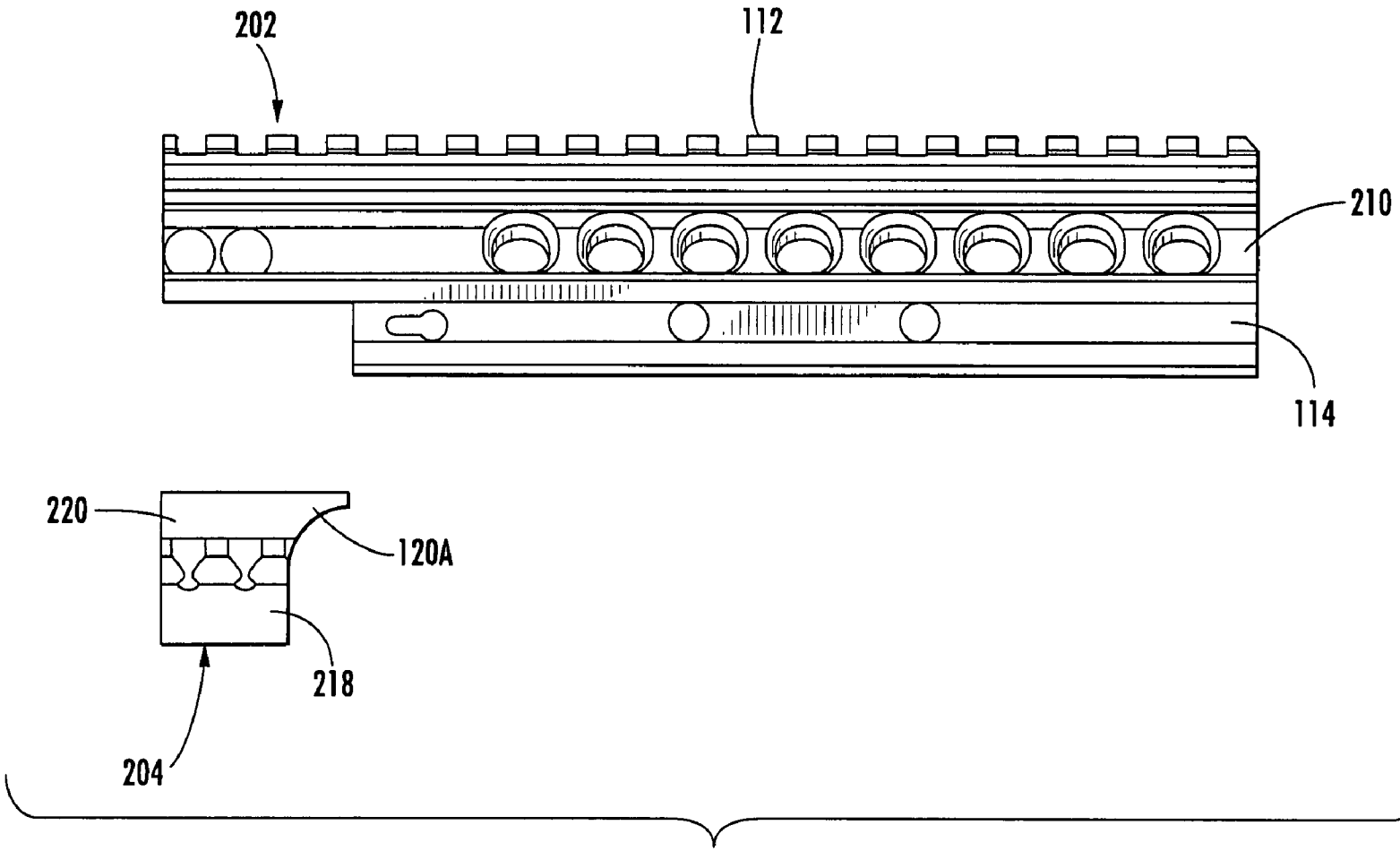
FIG. 9 is a side view of an upper accessory mount showing an alternate firearm interface means in the form of a clamp.
Figure 10:
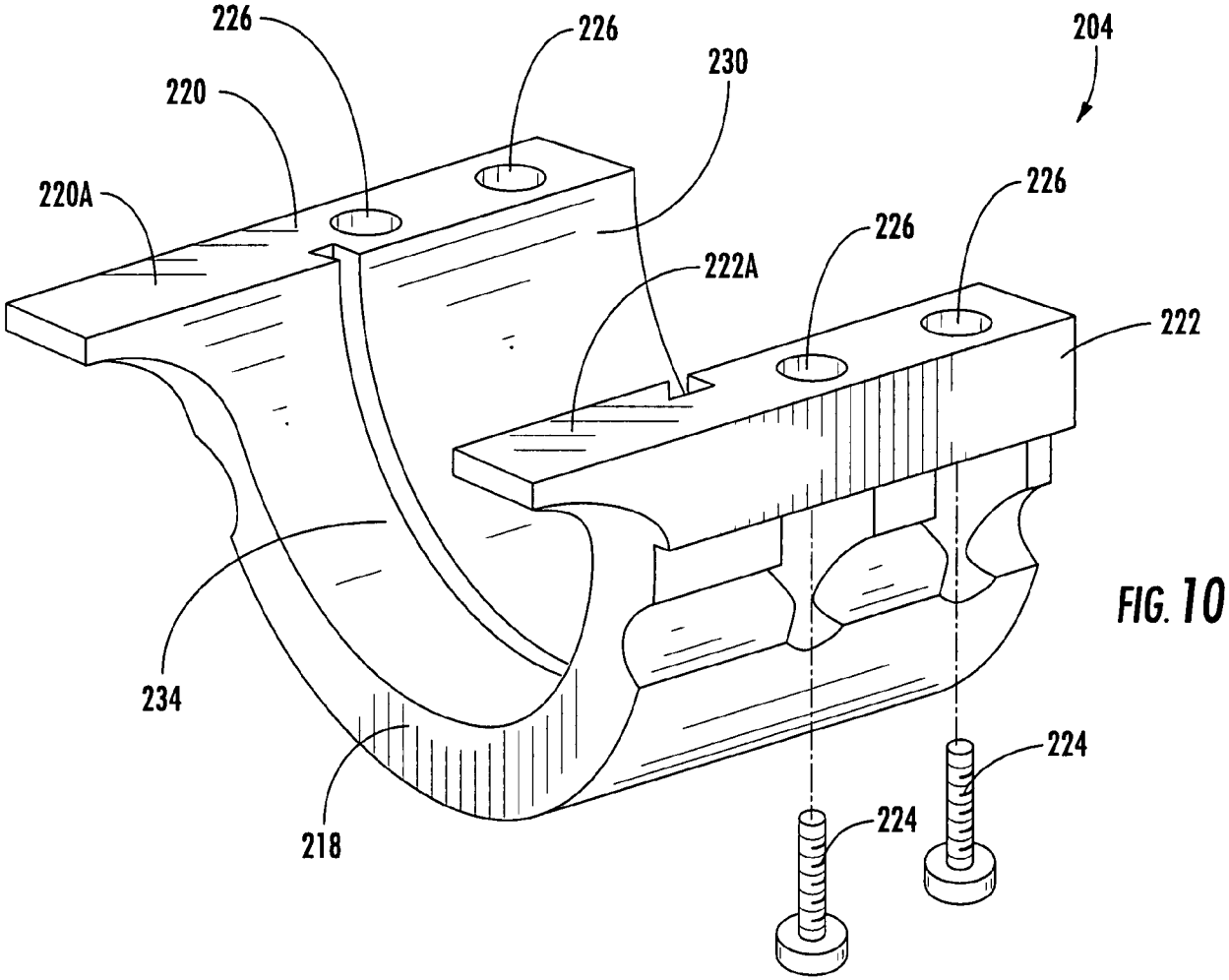
FIG. 10 is a perspective view of the clamp member in FIG. 9.

Referring now to FIGS. 9 and 10, an alternate embodiment upper accessory mount is shown and generally illustrated at 202. The upper sleeve is not configured to extend over the firearm 10 upper receiver 14 and engage the top of the upper receiver 14. In this embodiment, the upper accessory mount 202 includes a clamp or yoke 204 that is provided at the rearward end of the upper accessory mount 202 to removably secure the upper accessory mount 202 to the barrel nut 26 of the firearm 10. The clamp 204 includes a body portion 218 that is generally semi-cylindrical in shape, and further includes two flanges 220, 222 extending outwardly to the sides. Fasteners 224 extend through aligned openings 226 in the flanges 220, 222 and the opposing side walls of the upper accessory mount 202 to draw the clamp 204 and upper accessory mount 202 together around the barrel nut 26. While in the FIGS. four fasteners 224 are shown for attaching the clamp 204 to the upper accessory mount 202, the number of fasteners 224 can vary and may include one fastener 224 per side or three fasteners 224 per side. The rearward end of the upper accessory mount 202 and the clamp 204 include inner clamping surfaces 230 configured to cooperatively engage the outer surfaces of the barrel nut 26 as well as encircle the toothed flange of the barrel nut. In particular, a circular groove 234 is formed in each of the clamping surfaces 230 to accommodate the toothed flange On the barrel nut 26. The front ends of each of the flanges 220, 222 of the clamp 204 includes an extended support shelf 220A, 222A to further reduce downward bending moments, as added weight is applied to the forward end of the upper accessory mount 202. The length of the shelves 220A, 222A can be varied according to the length of the upper accessory mount 202, longer accessory mounts 202 (for firearms with longer barrels) would benefit from an elongated shelf.

The upper accessory mount 202 includes downwardly extending side walls 210 that terminate at their lower ends with the mounting channels 112, 114 as were described above. The mounting channels are configured to receive the desired lower accessory 120 or adapter panels 118 there by completing the modular interface system.

Figure 11:
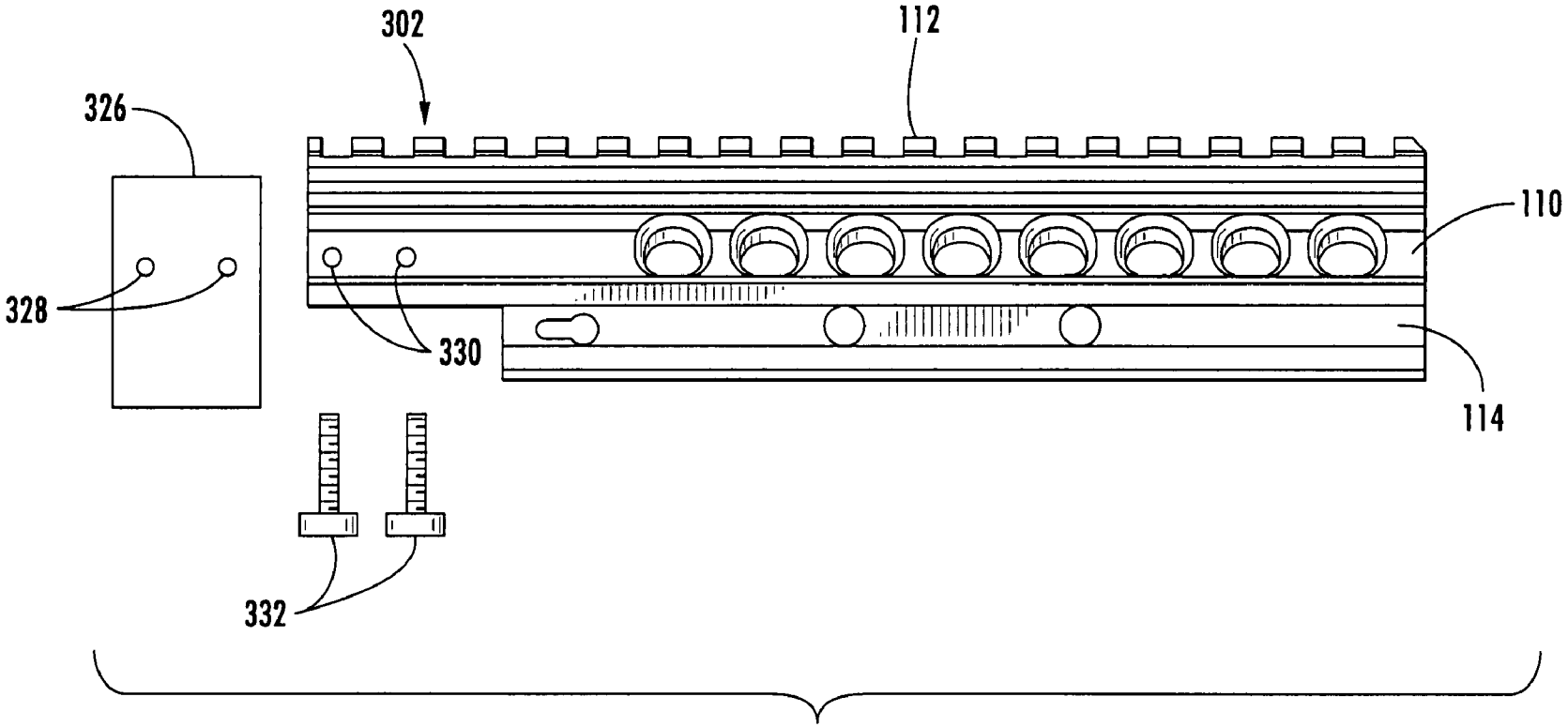
FIG. 11 is a perspective view of an upper accessory mount showing an alternate firearm interface means in the form of a replacement barrel nut.

FIG. 11 shows a third embodiment upper accessory mount 302. The upper accessory mount 302 engages the firearm receiver 14 by utilizing a replacement barrel nut 326. The standard firearm barrel nut 26 is removed and replaced with barrel nut 326. Barrel nut includes threaded mounting holes 328 therein. The upper accessory mount 302 also includes mounting holes 330 that align with the mounting holes 328 in the barrel nut 326. The upper accessory mount is then rigidly retained in place by installing threaded fasteners 332 through the holes in the upper accessory mount 302 into the holes 328 in the barrel nut 326. In this manner the upper accessory mount is rigidly attached to the barrel nut 326, which is in turn connected to the upper receiver 14. In all other respects, the upper accessory mount 302 operates and functions as described above.

It can therefore be seen that the present invention provides a unique modular interface system that allows various components of a weapons system to be integrated and reconfigured as desired without modifying the components. Further, the present invention can be utilized as both an OEM type structure or a retrofit system to allow quick and easy integration of various components within a diverse weapons system. For these reasons, the instant invention is believed to represent a significant advancement in the art, which has substantial utility and commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular accessory interface system for a firearm, said firearm including an upper receiver having a forward end and a rearward end, said upper receiver further including a dovetail rail extending longitudinally between the forward end and the rearward end, said upper receiver still further having a barrel receiving receptacle at a forward end thereof, said firearm further including a barrel received in said barrel receiving receptacle and a barrel nut received around an outer surface of said barrel receiving receptacle to retain said barrel within said barrel receiving receptacle, said modular accessory interface system comprising:

an upper accessory mount having a forward end, a rearward end, a rail extending between said forward end and said rearward end and symmetrically opposing side walls that extend outwardly and downwardly from said, said opposing side walls terminating in symmetrically opposing longitudinally extending mounting channels;

means for securing said rearward end of said upper accessory mount to said upper receiver of said firearm;

first and second mounting panels, each of said mounting panels having a upper portion and a lower portion, said upper portion including interfiting mating formations configured to be received and retained in said mounting channels, said lower portion of said first and second mounting panels configured to releasably receive and retain a lower firearm accessory therebetween; and fasteners to secure said lower portion of said mounting panels to said lower firearm accessory.

2. The modular accessory interface of claim 1, wherein each of said longitudinally extending mounting channels has an upper wall and a lower wall, and said lower wall comprises a plurality of spaced wall segments.

3. The modular accessory interface of claim 2, said interfitting mating formations on said first and second mounting panels comprising a plurality of spaced protrusions that matingly interfit between said spaced wall segments.

4. The modular accessory interface of claim 1, wherein said means for securing said rearward end of said upper accessory mount to said receiver comprises:

a sleeve extending from said rearward end of said upper accessory mount, said sleeve configured to extend over said upper receiver and engage said dovetail rail on said upper receiver.

5. The modular accessory interface of claim 1, wherein said means for securing said rearward end of said upper accessory mount to said receiver comprises:

a clamp removably fastened to said rearward end of said upper accessory mount, said rearward end of said upper accessory mount and said clamp including clamping surfaces configured to cooperatively engage an outer surface of said barrel nut and thereby entirely support said upper accessory mount on said barrel nut.

6. The modular accessory interface of claim 1, wherein said first and second mounting panels are engaged with said lower firearm accessory using screws.

7. The modular accessory interface of claim 1, said first and second mounting panels including protrusions extending inwardly to engage corresponding mating formations formed on said lower firearm accessory said protrusions and said mating formations cooperating to assist to engage and retain said lower firearm accessory.

8. The modular accessory interface of claim 7, wherein said first and second mounting panels are engaged with said lower firearm accessory using screws.

9. The modular accessory interface of claim 1, wherein said lower firearm accessory comprises a grenade launcher.

10. An accessory mounting system for interfacing accessory devices with a firearm accessory interface system, said accessory interface system including an upper accessory mount having a forward end, a rearward end, a rail extending between said forward end and said rearward end and symmetrically opposing side walls that extend outwardly and downwardly from said, said opposing side walls terminating in symmetrically opposing longitudinally extending mounting channels and means for securing said rearward end of said upper accessory mount to a firearm, said accessory mounting system comprising:

first and second mounting panels, each of said mounting panels having a upper portion and a lower portion, said upper portion including interfiting mating formations configured to be received and retained in said mounting channels, said lower portion of said first and second mounting panels configured to releasably receive and retain a lower firearm accessory therebetween; and fasteners to secure said lower portion of said mounting panels to said lower firearm accessory.

11. The accessory mounting system of claim 10, wherein each of said longitudinally extending mounting channels has an upper wall and a lower wall, and said lower wall comprises a plurality of spaced wall segments, said interfitting mating formations on said first and second adapter panels comprising a plurality of spaced protrusions that matingly interfit between said spaced wall segments.

12. The accessory mounting system of claim 10, wherein said first and second adapter panels are engaged with said firearm accessory using screws.

13. The accessory mounting system of claim 10, said first and second adapter panels including protrusions extending inwardly to engage corresponding mating formations formed on said lower firearm accessory said protrusions and said mating formations cooperating to engage and retain said firearm accessory.

14. The accessory mounting system of claim 13, wherein said first and second adapter panels are engaged with said firearm accessory using screws.

15. The accessory mounting system of claim 10, wherein said firearm accessory comprises a grenade launcher.

16. A modular weapons interface system comprising:

an upper accessory mount having a forward end, a rearward end, a rail extending between said forward end and said rearward end and symmetrically opposing side walls that extend outwardly and downwardly from said, said opposing side walls terminating in symmetrically opposing longitudinally extending mounting channels, said upper accessory mount further including and means for securing said upper accessory mount to a mounting surface;

first and second mounting panels, each of said mounting panels having a upper portion and a lower portion, said upper portion including interfiting mating formations configured to be received and retained in said mounting channels, said lower portion of said first and second mounting panels configured to releasably receive and retain a weapon system therebetween; and fasteners to secure said lower portion of said mounting panels to said weapon system.

17. The modular weapons interface system of claim 16, wherein each of said longitudinally extending mounting channels has an upper wall and a lower wall, and said lower wall comprises a plurality of spaced wall segments, said interfitting mating formations on said first and second adapter panels comprising a plurality of spaced protrusions that matingly interfit between said spaced wall segments.

18. The modular weapons interface system of claim 16, wherein said first and second adapter panels are engaged with said weapon system using screws.

19. The modular weapons interface system of claim 16, wherein said first and second adapter panels include protrusions extending inwardly to engage corresponding mating formations formed on said weapon system said protrusions and said mating formations cooperating to engage and retain said weapon system.

20. The modular weapons interface system of claim 19, wherein said first and second adapter panels are engaged with said weapon system using screws.

* * * * *